US006693386B2

(12) United States Patent
DiSanto et al.

(10) Patent No.: US 6,693,386 B2
(45) Date of Patent: Feb. 17, 2004

(54) REFLECTIVE EDGE FIELD-EMISSION PIXEL AND ASSOCIATED DISPLAY

(75) Inventors: Frank J. DiSanto, Manhasset, NY (US); Denis A. Krusos, Lloyd Harbor, NY (US); Sergey L. Shokhor, E. Setauket, NY (US); Alexander Kastalsky, Wayside, NJ (US); Boris Isaakovich Gorfinkel, Saratov (RU); Nikolayi Pavlovich Abanshin, Saratov (RU)

(73) Assignee: Copytele, Inc., Melville, NY (US)

( * ) Notice: Subject to any disclaimer, the term of this patent is extended or adjusted under 35 U.S.C. 154(b) by 0 days.

(21) Appl. No.: 10/243,894

(22) Filed: Sep. 13, 2002

(65) Prior Publication Data

US 2003/0178945 A1 Sep. 25, 2003

Related U.S. Application Data

(63) Continuation-in-part of application No. 10/102,450, filed on Mar. 20, 2002.

(60) Provisional application No. 60/403,938, filed on Aug. 16, 2002, and provisional application No. 60/399,825, filed on Jul. 31, 2002.

(51) Int. Cl.[7] ..... G09G 3/10

(52) U.S. Cl. ..... 315/169.1; 313/310; 313/497

(58) Field of Search ..... 315/169.1, 169.3, 315/169.4; 313/495, 496, 497, 310, 311, 306; 345/60, 67

(56) References Cited

U.S. PATENT DOCUMENTS

| | | | | | |
|---|---|---|---|---|---|
| 5,620,832 | A | * | 4/1997 | Sung et al. | 430/311 |
| 6,032,126 | A | * | 2/2000 | Kaehler | 705/16 |
| 6,329,750 | B1 | * | 12/2001 | Hofmann et al. | 313/495 |
| 6,614,149 | B2 | * | 9/2003 | Kastalsky et al. | 313/310 |

* cited by examiner

*Primary Examiner*—Don Wong
*Assistant Examiner*—Thuy Vinh Tran
(74) *Attorney, Agent, or Firm*—Duane Morris LLP

(57) ABSTRACT

A Reflective Field Emission Display (FED) pixel element and system employing same are disclosed. In the FED system disclosed, each pixel element is composed of at least one emitter that is operable to emit electrons and at least one reflector that is operable to attract and reflect the emitted electrons onto a transparent anode layer that oppositely positioned with respect to the emitter and reflector and is operable to attract the reflected electrons. In one aspect of the invention, the emitter layer is shaped to bound the reflector layer forming an electrical boundary that focuses the reflected electron beam onto a phosphor layer interposed between the transparent layer. In another aspect of the invention, a high voltage and a corresponding high voltage phosphor is applied to the transparent anode layer. The use of high voltage and high voltage phosphor is advantageous as it causes the reflected electrons to be drawn deeper into the phosphor layer and, hence, reduces unwanted emissions back into the vacuum of the pixel element. In still another aspect of the invention, a plurality of phosphor layers are applied to the transparent layer to produce a color display as reflected electrons are attracted to the transparent layer.

51 Claims, 9 Drawing Sheets

REFLECTIVE EDGE FIELD-EMISSION PIXEL AND ASSOCIATED DISPLAY

PRIORITY FILING DATE

This application claims the benefit of the earlier filing date, under 35 U.S.C. §119, of U.S. Provisional Patent Applications;

Serial No. 60/403,938, entitled "Configuration of Edge Emitter Display," filed on Aug. 16, 2002; and Serial No. 60/399,825, entitled "Reflective Edge Emitter FED with Shaped Emitter Layer," filed on Jul. 31, 2002, the entirety of which are incorporated by reference herein.

RELATED APPLICATIONS

This application is a continuation-in-part of commonly assigned, co-pending, patent application:

Ser. No. 10/102,450, entitled "Field-Emission Matrix Display Based on Electron Reflection," filed on Mar. 20, 2002, the entirety of which is incorporated by reference herein.

FIELD OF THE INVENTION

The present invention relates to solid-state displays and more specifically to edge-emitter reflective field emission pixel elements having shaped emitter elements for electron beam focusing for displays.

BACKGROUND OF THE INVENTION

Solid state and non-Cathode Ray Tube (CRT) display technologies are well-known in the art. Light Emitting Diode (LED) displays, for example, include semiconductor diode elements that may be arranged in configurations to display alphanumeric characters. Alphanumeric characters are then displayed by applying a potential or voltage to specific elements within the configuration. Liquid Crystal Displays (LCD) are composed of a liquid crystal material sandwiched between two sheets of a polarizing material. When a voltage is applied to the sandwiched materials, the liquid crystal material aligns in a manner to pass or block light. Plasma displays conventionally use a neon/xenon gas mixture housed between sealed glass plates that have parallel electrodes deposited on the surface.

Passive matrix displays and active matrix displays are flat panel displays that are used extensively in laptop and notebook computers. In a passive matrix display, there is a matrix or grid of solid-state elements in which each element or pixel is selected by applying a potential to a corresponding row and column line that forms the matrix or grid. In an active matrix display, each pixel is further controlled by at least one transistor and a capacitor that is also selected by applying a potential to a corresponding row and column line. Active matrix displays provide better resolution than passive matrix displays, but they are considerably more expensive to produce.

While each of these display technologies has advantages, such as low power and lightweight, they also have characteristics that make them unsuitable for many other types of applications. Passive matrix displays have limited resolution, while active matrix displays are expensive to manufacture.

The edge emitter FED pixel element disclosed in U.S. patent application Ser. No. 10/102,450, entitled "Field-Emission Matrix Display Based on Electron Reflection," is representative of a pixel element that may be included in a low-cost, lightweight, high-resolution display system. In such a display, a high screen brightness with a minimum power consumption is advantageous. One method for achieving a high screen brightness is to concentrate the reflected electron beam onto an associated phosphor layer with little or no scattering, or cross-talk, of the electron beam from one pixel element into adjacent pixel elements, or as will be appreciated, an adjacent sub-pixel element.

Hence, there is a need for a method of concentrating or focusing the electron beam of edge-emitter FED pixel elements onto associated phosphor layers to substantially reduce electron beam cross-talk between adjacent elements.

SUMMARY OF THE INVENTION

An edge-emitter Field Emission Display (FED) pixel element and associated matrix display is disclosed. The FED pixel element has a reflector layer and an anode layer having a phosphor layer thereon, and a shaped emitter layer, which bounds a reflector layer and focuses a reflected electron beam to avoid scattering of the electron beam as it travels to the anode. Also disclosed is the use of high-voltage and high-voltage phosphor on the anode layer that advantageously improves the pixel element's operational life. Also disclosed, is a method of determining the voltage on the anode layer to enhance the focusing of the electron beam based on the distance between the anode and the reflecting surface. In another aspect of the invention, a plurality of phosphor layers are applied to the transparent layer, which produce different levels of color as reflected electrons are attracted to the transparent layer and bombard corresponding phosphor layers.

Figure 1A:
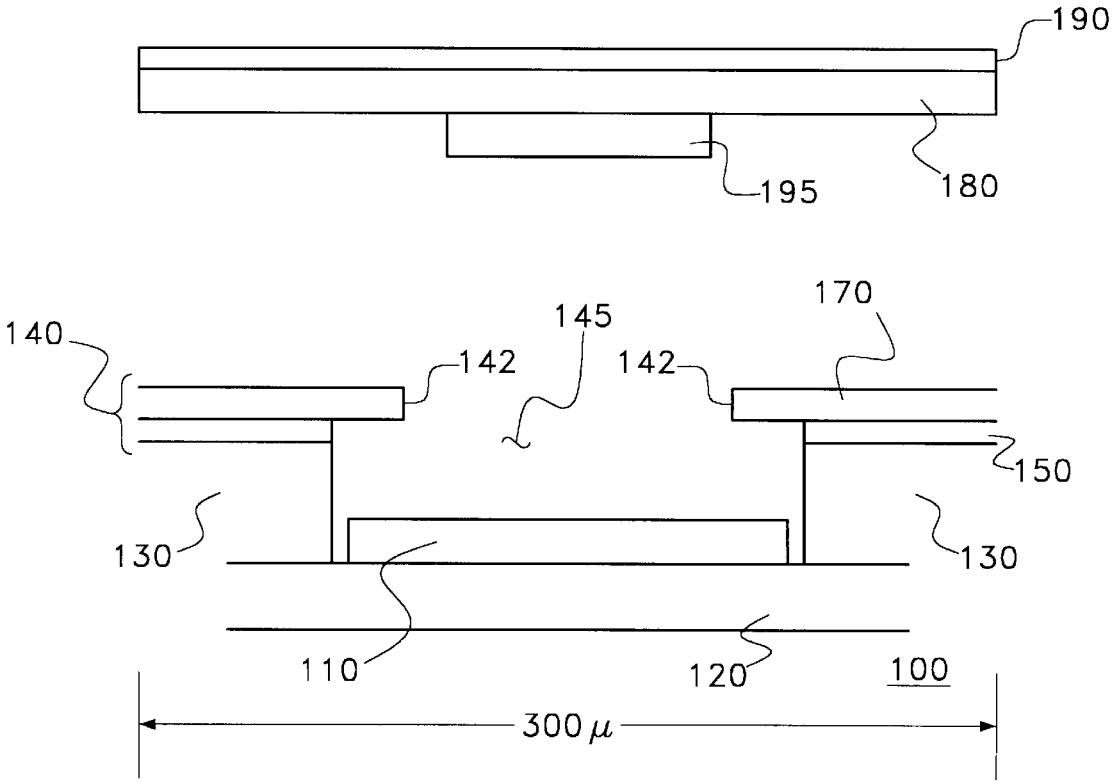
FIGS. 1*a*–1*e* illustrate cross-sectional views of different embodiments of Field-Emission Display (FED) pixel element in accordance with the principles of the invention.

It is to be understood that these drawings are solely for purposes of illustrating the concepts of the invention and are not intended as a definition of the limits of the invention. It will be appreciated that the same reference numerals, possibly supplemented with reference characters where appropriate, have been used throughout to identify corresponding parts.

DETAILED DESCRIPTION OF THE INVENTION

FIG. 1*a* illustrates a cross-sectional view of an edge-emitter Field Emission Display (FED) pixel element 100 in accordance with the principles of the invention. In this exemplary embodiment, pixel element 100 is fabricated by depositing at least one reflective layer 110 on a dielectric or non-conductive substrate 120, e.g. glass, silicon dioxide (SiO2). Reflective layer 110 is representative of an electrode that may also be used to control a voltage or potential applied to pixel elements 100 that are arranged in a row or column, which are oriented orthogonal to the plane of FIG. 1*a*, as will more fully be explained. Reflective electrode 110 may be any material possessing a high electrical conductivity and reflectivity selected from a group of metals, such as, gold, silver, aluminum, vanadium, niobium, chromium, molybdenum, etc. In a preferred embodiment, reflective layer 110 is formed from niobium.

Insulator layer 130, preferably silicon dioxide, $SiO_2$, is next deposited on reflective layer 110. Insulator layer 130 electrically isolates reflective layer 110 and is preferably in the range of about 0.5 microns thick. Emitter layer 140 is next deposited on insulating layer 130. Emitter layer 140 is of a material that is operative to emit electrons when a sufficient potential difference exists between reflective layer 110 and emitter layer 140. Emitter layer 140 is preferably selected from materials that emit electrons from an edge 142 when a potential difference exists between reflector layer 110 and emitter layer 140. In the illustrated, and preferred, embodiment, emitter layer 140 is comprised preferably of a bottom conductive layer 150 and an edge emitter layer 170 having emitter edge 142. Emitter edge layer or cathode layer 170 is composed of a material having a low-work function for emitting electrons. Emitter edge layer 170 may be a resistive material. In a preferred embodiment emitter edge layer 170 is an alpha-carbon ($\alpha$-C) material formed as an edge in the range of 50–80 nanometers-thick. Alpha-carbon film is well known to have a low work function for electron emission into a vacuum. Conductive layer 150 is representative of an electrically conductive material that provides an electrical contact to the edge emitter layer 170 and may be used as a column or row connector in a FED display, as will be further explained.

Pixel well 145 is next created by etching, for example using photo-resistant patterning, through emitter layer 140 and insulator film layer 130 to expose reflector layer 110. Emitter layer 140 is etched or shaped such that it borders on all sides, i.e., circumjacent, exposed reflector layer 110. Photo-resistant patterning is well known in the art and need not be discussed in detail herein. Pixel 100 preferably is in the order of 300×300 microns.

As will be appreciated, the exposed width of reflector layer 110 may be determined by appropriately timing the etching of insulating layer 130. Hence, in one aspect, emitter layer 140, and more specifically, edge 142 and reflective layer 110 may be aligned and non-overlapping, i.e., self-aligned. In another aspect, emitter layer 140, and more specifically, edge 142 may overlap reflective layer 110, as shown.

A transparent electrode, preferably an Indium Titanium Oxide (ITO) 180 is deposited on transparent plate 190, e.g., glass. ITO layer 180 is an optically transparent conductive material that may be used to provide a known potential in selective areas of ITO 180.

Phosphor layer 195 is then deposited on ITO 180. Phosphor layer 195 produces a predetermined or desired level of photonic activity or illumination when activated or bombarded by impinging electrons. In a preferred aspect, phosphor layer is deposited such that it is opposite a corresponding pixel well 145.

Although not shown, it would be appreciated that a dielectric material, such as $SiO_2$, may be selectively placed as spacers to electrically separate transparent substrate 190 and emitter layer 140.

The confined pixel volume contained between pixel well 145 and transparent surface 190 is further evacuated to a pressure in the range of, $10^{-5}$ to $10^{-7}$, and preferably, $10^{-6}$ torr. Methods for evacuating the gases within a sealed pixel element are well known in the art and need not be discussed in detail.

In the operation of pixel element 100, the application of a positive voltage or potential to reflective layer 110 relative to emitter layer 140 creates an electrical field that draws electrons from edge 142 of emitter layer 140 to reflective layer 110. Electrons reflected from reflective layer 110 are then attracted to a positive voltage applied to ITO layer 180, which in turn bombard phosphor layer 195. It will be appreciated that emitter layer 140 and reflective layer 110 may be held at a known potential difference with is not sufficient to cause the emission of electrons from emitter layer 140. An additional voltage, in the form of a pulse, may then be applied to reflective layer 110 to create a potential difference sufficient for emitter layer 140 to emit electrons.

As will be appreciated, the gap between the edge 142 and reflector layer 110 can be made extremely small, preferably less than or equal to one (1) micron. In this case, the voltage or potential difference between edge 142 and reflector layer 110 can be reduced to a level between 20 and 200 volts. In a preferred embodiment, the potential between emitter layer 140 and reflector layer 110 is in the order of 25–50 volts. The potential of the combined phosphor 195/ITO layer 180 may be kept at a significantly higher voltage to attract reflected electrons to a corresponding phosphor layer to illuminate substantially the entire phosphor layer corresponding the pixel element without reflected electrons being spread into an adjacent pixel element phosphor layer.

Figure 1B:
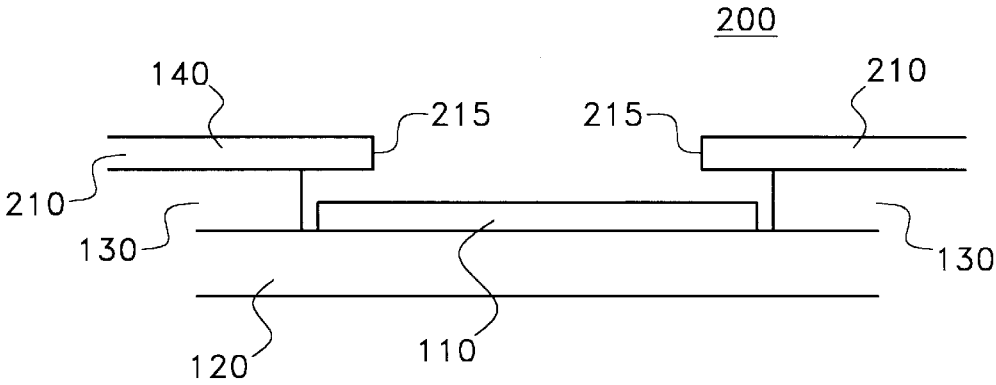

FIG. 1*b* illustrates a second embodiment 200 of the invention in which emitter layer 140 is represented as layer 210. In this embodiment, layer 210 is made of a conductive material suitable for emitting electrons from edge 215 when a potential difference exists between reflector layer 110 and emitter layer 210. In this embodiment, layer 210 may be an electrically conductive material such as gold, silver, aluminum, molybdenum, etc. Preferably, layer 210 is fabricated from molybdenum.

Figure 1C:
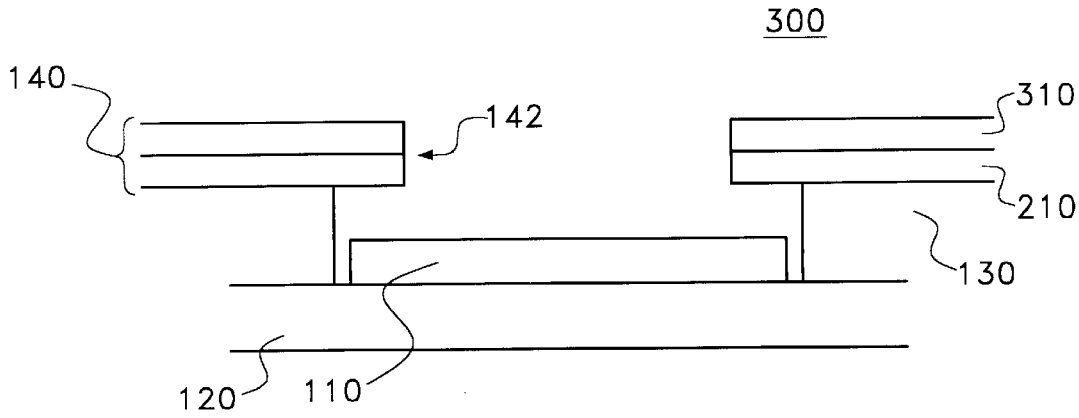

FIG. 1*c* illustrates a third embodiment 300 of the present invention in which emitter layer 140 includes layer 210 and insulating layer 310, such as $SiO_2$, deposited on layer 210.

Figure 1D:
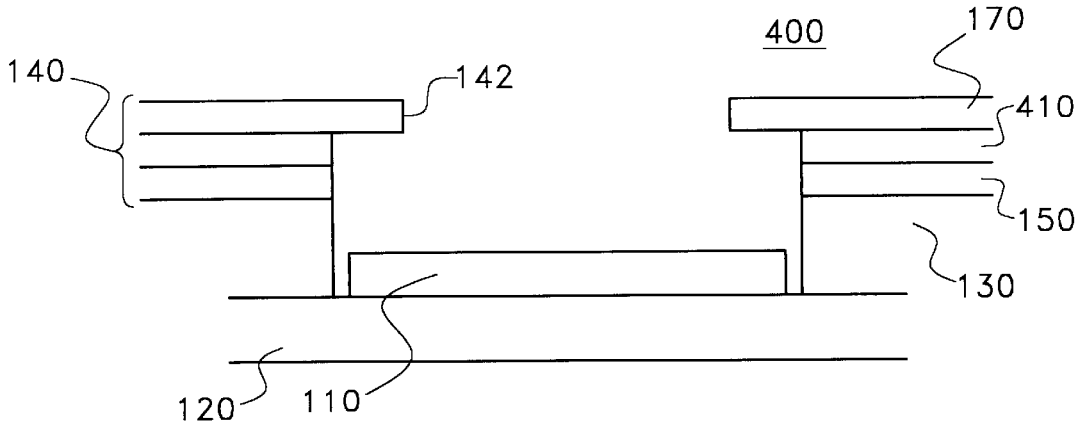

FIG. 1*d* illustrates a fourth embodiment 400 of the present invention in which emitter layer 140 is composed of a resistive material 410, such as alpha-silicon ($\alpha$-Si), imposed between conductive layer 150 and edge emitter layer 170, of FIG. 1*a*.

Figure 1E:
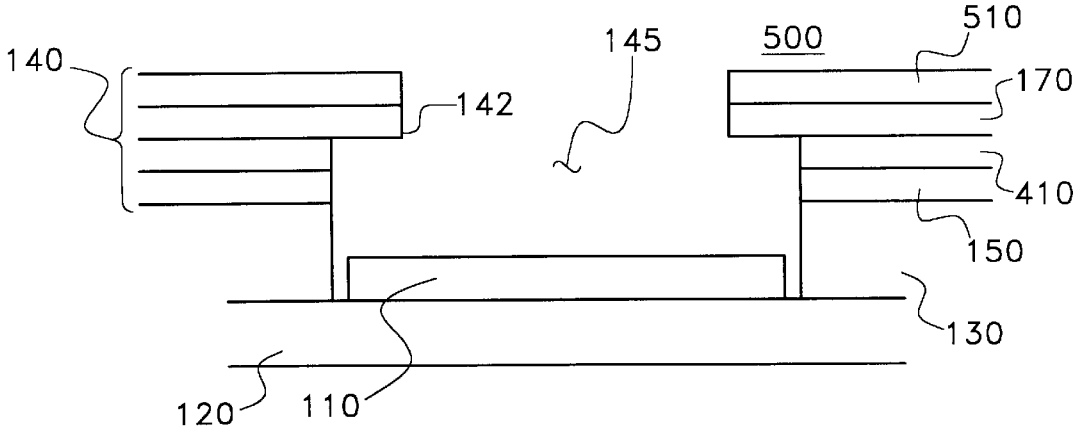

FIG. 1*e* illustrates a fifth embodiment 500 of the present invention, in which insulating layer 510 is deposited on edge emitter layer 170 shown in FIG. 1*d*. Although not shown it will be appreciated that edge emitter layer 170 may be replaced by materials similar to those selected for edge emitter layer 210.

Figure 2A:
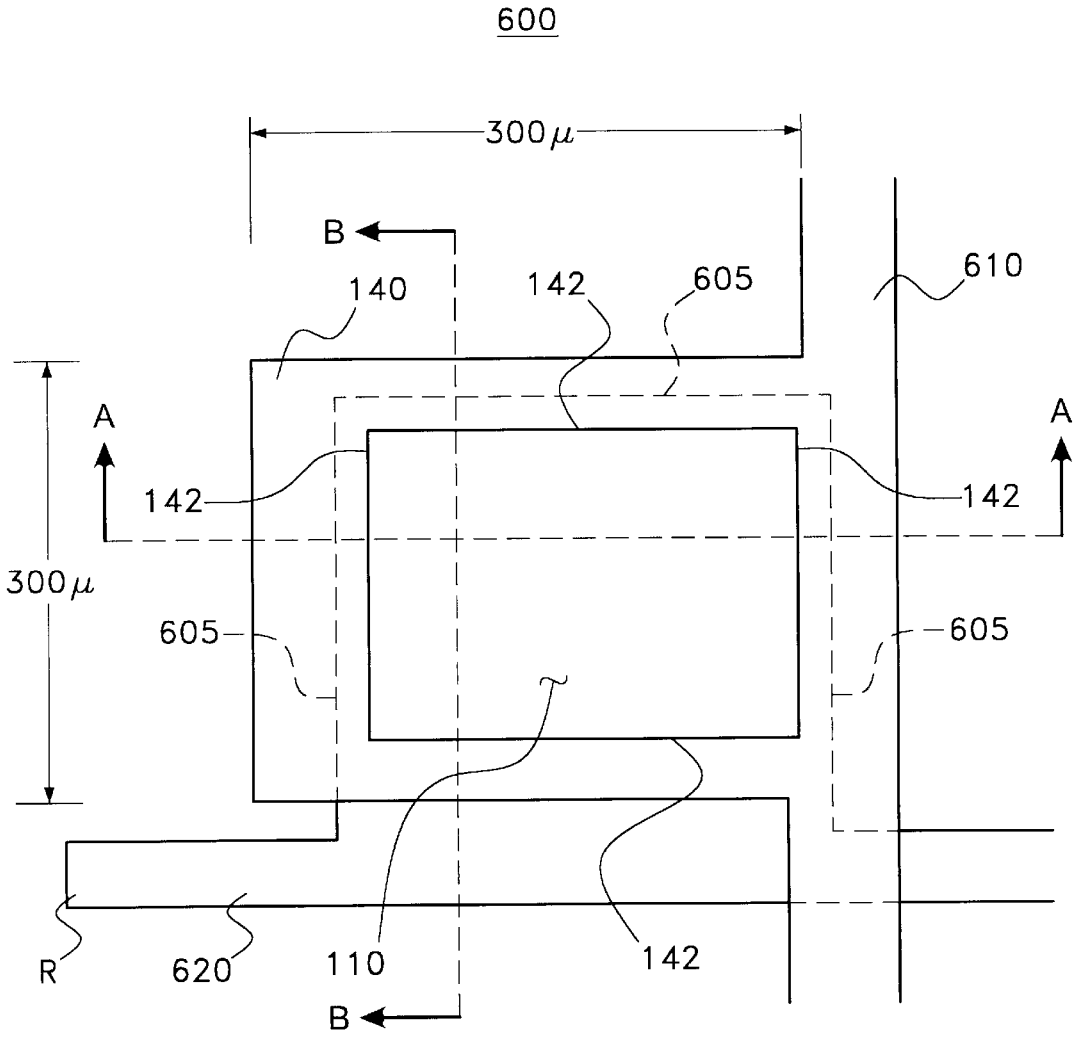
FIGS. 2*a*–2*b* illustrate a top view of the shaped-emitter pixel element in accordance with the principles of the invention.

FIG. 2*a* illustrates a top view of a shaped-emitter, non-self-aligned, pixel element 600 in accordance with the principles of the invention. In this aspect, the edges 142 of emitter layer 140 extend over reflective layer 110, as represented by dashed lines 605. Emitter layer 140 is further shaped such that edges 142 form a perimeter, vertically offset from, around the reflective surface of reflector layer 110. In this aspect, the reflective surface is substantially contained within the perimeter boundary determined by the edges 142. A potential or voltage applied to emitter layer 140, thus, creates an electrical barrier that restrains, or confines, the direction of electrons reflected from reflector layer 110 to remain within the bounds of edges 142. Restraint or containment of the reflected electron beam substantially within the bounds of edges 142 is advantageous as it limits the spread of the electron beam and reduces cross-talk between pixel element or sub-pixel elements in color displays, as will be shown.

Further illustrated is that emitter layer 140 may be in electrical communication with similar pixel elements (not shown) by at least one column row line 610 and reflective layer 110 may be in electrical communication with similar pixel elements (not shown) by row lines 620. As is known in the art, pixel element 100 may be identified or addressed in a display unit composed of a matrix of similar pixel elements by its row identifier and its column identifier. Pixel element 600 may also be identified by a plurality of emitter layer 140 connected in rows and reflector layers 110 connected in columns, as is well-known.

Figure 2B:
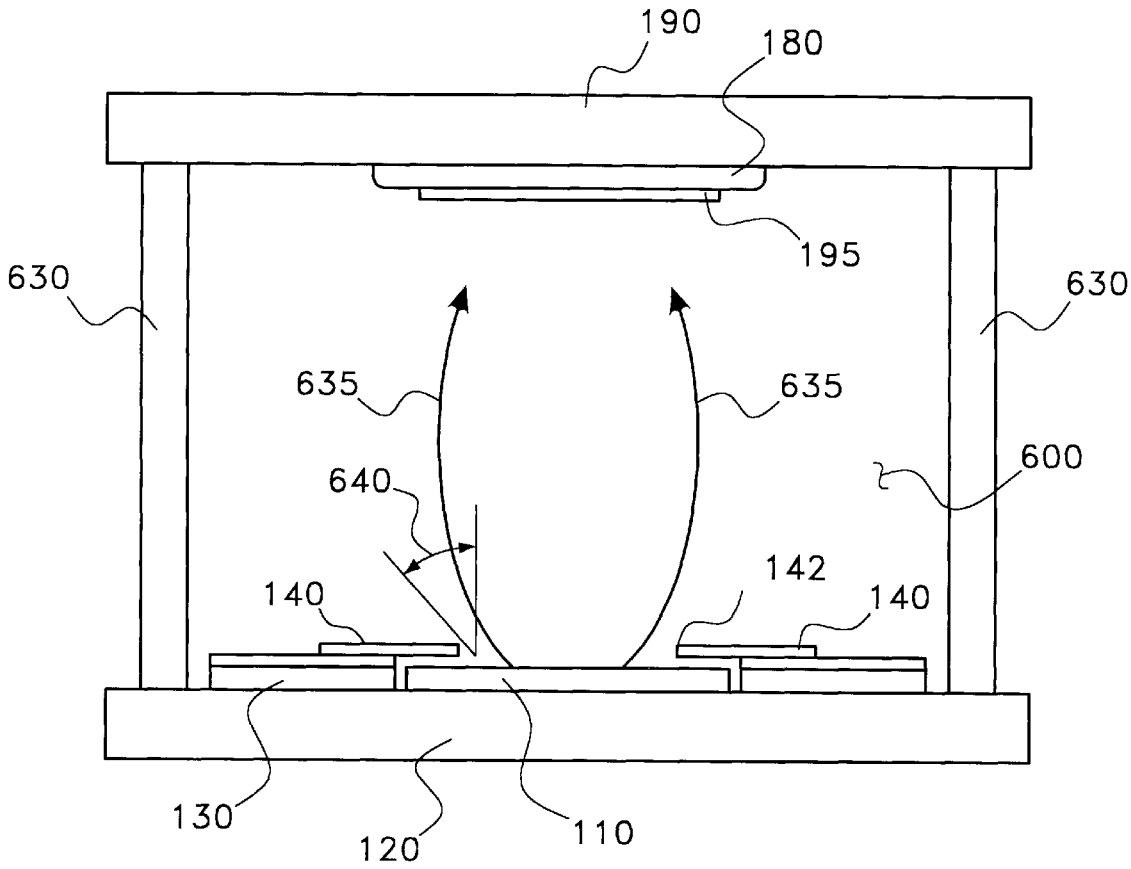

FIG. 2*b* illustrates a cross-sectional view through section A—A of the pixel element 600 shown in FIG. 2*a*, showing paths of electrons reflected from reflector layer 110. In this case, electrons 635 emitted from emitter layer 140 are attracted to, and reflected from, reflector layer 110. The path of electrons reflected from reflector layer 110 at an initial angle substantially different than 90 degrees, as illustrated by angle 640, may be directed or deflected by the potential difference between the reflected electron and the potential or voltage applied to emitter layer 140 to a substantially perpendicular direction of travel to ITO layer 180. Hence, electrons 635 may be substantially maintained within the bounds of emitter layer 140 and as fewer electrons 635 penetrate the electrical barrier created by shaped-emitter layer 140 less interference with adjacent phosphor layers occurs and more electrons strike the desired phosphor layer 195.

Also illustrated are spacers 630, which provide electrical separation of the electrically conductive ITO layer 180 and emitter layer 140. Spacers 630 are conventionally fabricated from a dielectric material, such as $SiO_2$, and further provide mechanical support to transparent layer 190 when the volume between transparent layer 190 and pixel well 145 is evacuated to create a vacuum therein.

Although not shown, it would be appreciated that a cross-section view through section B—B of FIG. 2*a* would provide a similar deflection of reflected electrons. Hence, reflected electrons are restrained in both a lateral and orthogonal direction.

Figure 3:
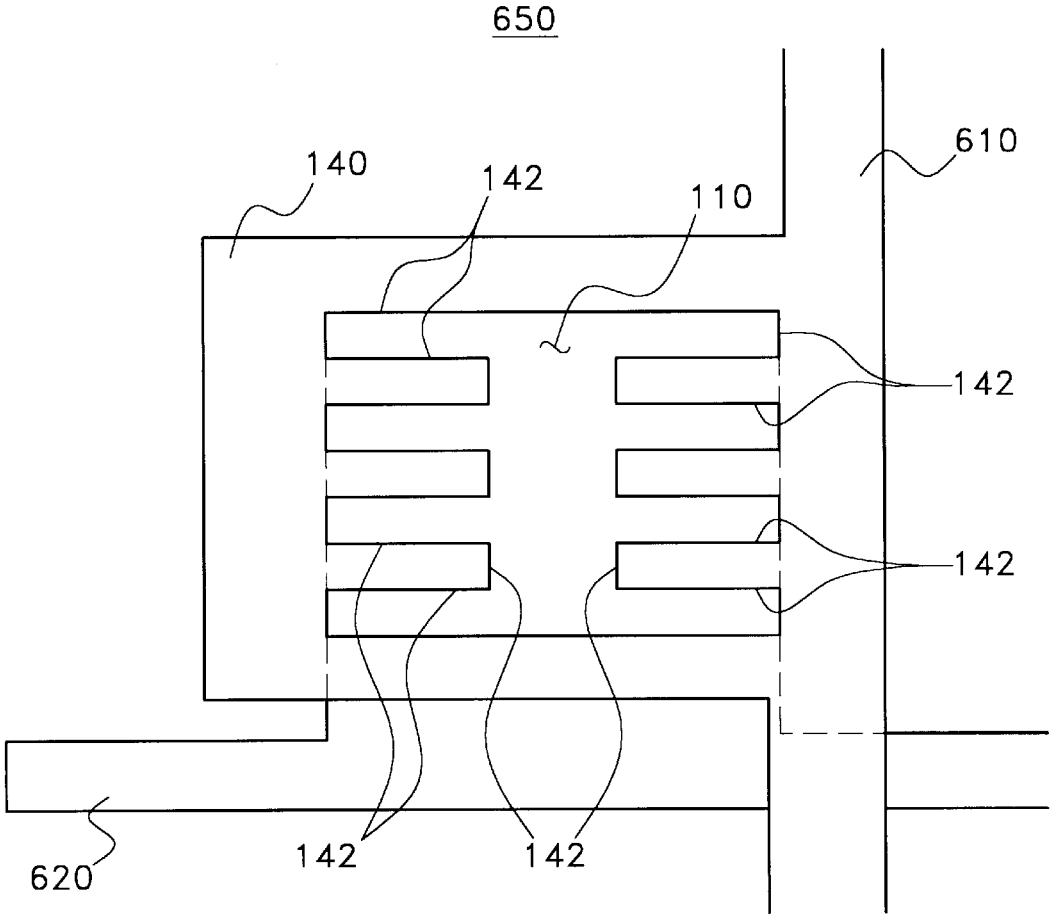
FIG. 3 illustrates a top view of the second embodiment of a shaped-emitter pixel element in accordance with the principles of the invention.

FIG. 3 illustrates a top view of a second aspect of the shaped emitter layer 140 in accordance with the principles of the invention. In this aspect, emitter layer 140 is further shaped to contain a plurality of digits or projections that extend over reflective surface of reflector layer 110. This addition of digits or projections to shaped-emitter layer 140 is advantageous as it increases the length of edge 142, which increases the number of emitted electrons. Also, the increased edge length creates additional electrical barriers that further restrain electrons from exiting the pixel region.

Figure 4A:
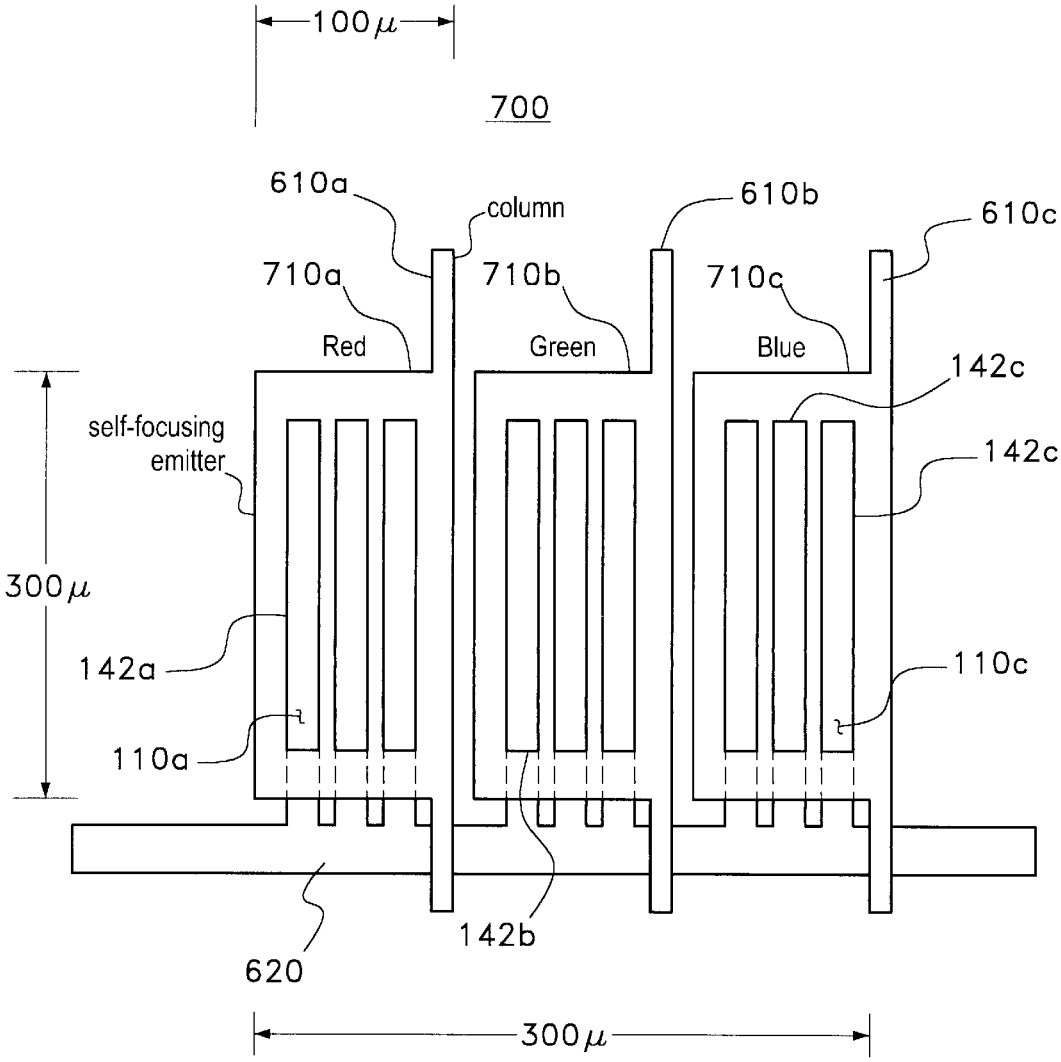
FIGS. 4*a* and 4*b* illustrate top views of shaped-emitter pixel elements for color pixel elements in accordance with the principles of the invention.

FIG. 4*a* illustrates a top view of another embodiment 700 of a color FED pixel element in accordance with the principles of the present invention. In this embodiment, pixel 700 is partitioned into three sub-pixel elements, represented as 710*a*, 710*b*, 710*c*, which may be associated with red, green and blue phosphor layers, i.e., RGB.

In a FED display system, each sub-pixel element is independently controlled by column lines 610*a*, 610*b*, 610*c* and row line 620. Each sub-pixel emitter edge, represented as 142*a*, 142*b*, 142*c*, respectively, operates as previously described to prevent electrons emitted from a corresponding reflector layer 110*a*, 110*b*, 110*c*, to impinge upon the phosphor layers corresponding to an adjacent sub-pixel element phosphor layer. To maintain a desired 330×330 micron pixel size, each sub-pixel element 710*a*, 710*b*, 710*c*, is in the order of 330×110 microns.

Figure 4B:
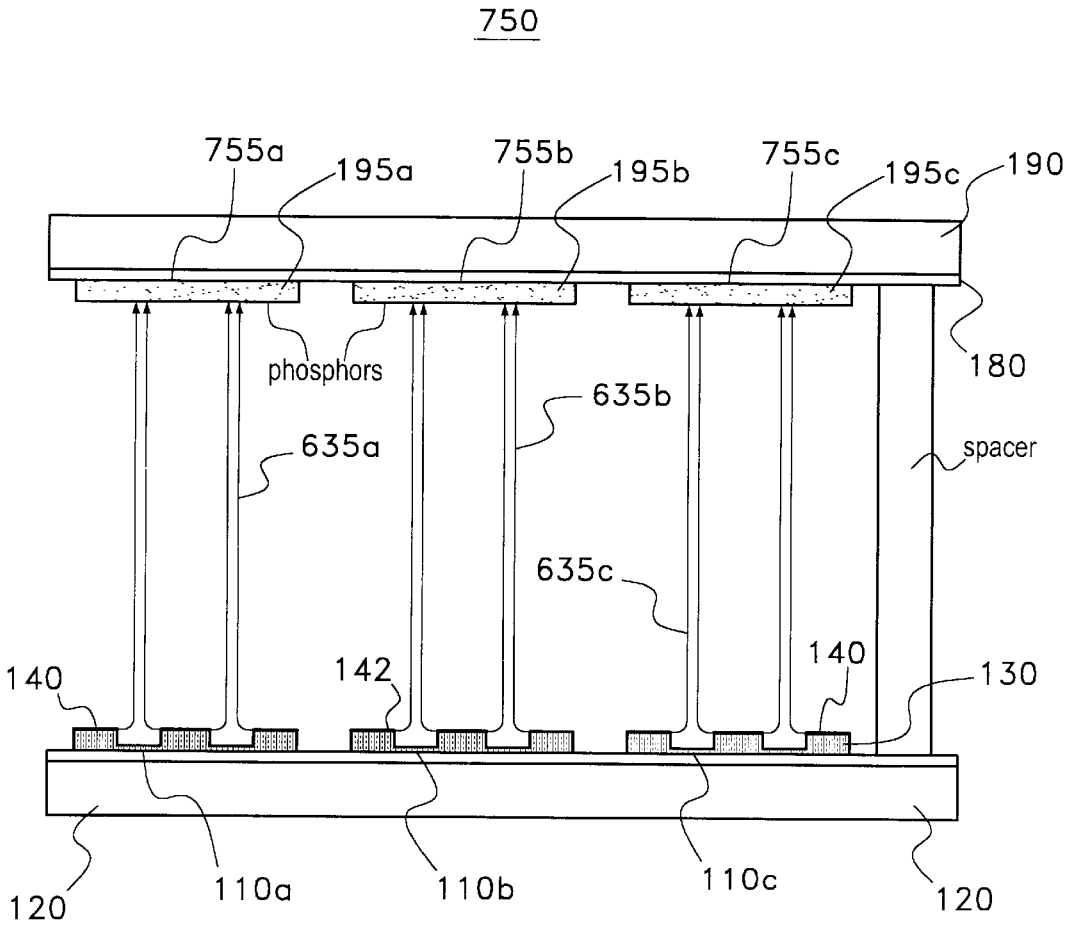

FIG. 4*b* illustrates a cross-sectional view of embodiment shown in FIG. 4*a*, which depicts the containment of electron beams, 635*a*, 635*b*, 635*c*, reflected from corresponding reflector layers 110*a*, 110*b*, 110*c*, as they are attracted to phosphor layers 755*a*, 755*b*, 755*c*. In a preferred embodiment phosphor layers 755*a*, 755*b*, 755*c* emit a light in a band corresponding to one of the primary colors, i.e., red, green, blue. As would be appreciated the selection of colors and the order of the color phosphor layers may be exchanged without altering the scope of the invention.

Figure 5:
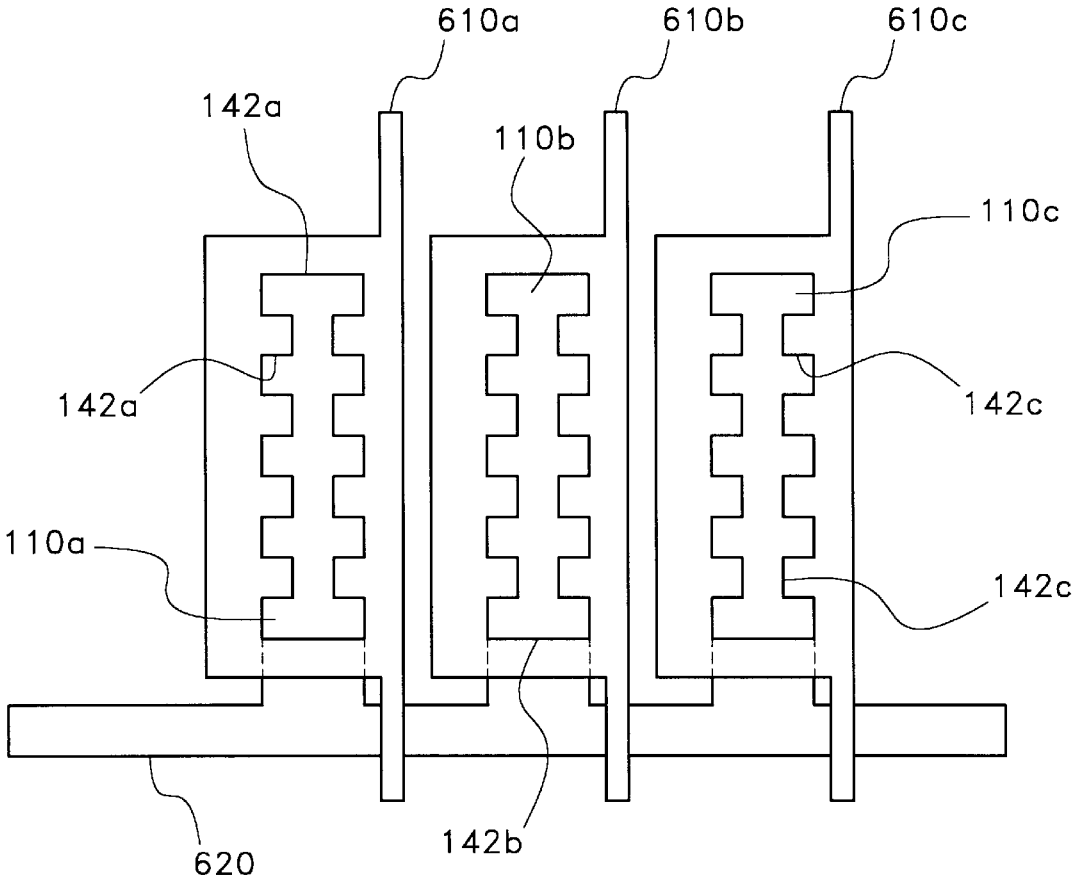
FIG. 5 illustrates a cross sectional view of a color pixel element in accordance with the principles of the present invention.

FIG. 5 illustrates a top-view of a preferred embodiment of a color FED pixel element using a shaped-emitter layer similar to that shown in FIG. 3. As previously discussed, the increase of the length of the emitter layer 140 edge 142 is advantageous as it increases the number of electrons emitted.

Returning to FIG. 2*b*, it will be understood, that the confinement of the electron path by shaped-emitter layer 140 is not exact and electrons 635 may continue toward ITO layer 180 on a path that may not be substantially perpendicular to reflector layer 110. Hence, electron beam paths may cross before reaching the corresponding phosphor layer. One factor where electron beams may cross is the voltage or potential applied to ITO layer 180 as this voltage determines the level of attraction of electrons to ITO layer 180. Thus, the electrons beam may be focused to a point between ITO layer 180 and reflector layer 110. Hence, to have a maximum number of electrons strike a corresponding phosphor layer, ITO layer 180 may be positioned approximately at the electron focal point. Table 1 tabulates voltage or values on ITO layer 180 with regard to a distance between ITO layer 180 and reflector layer 110 that achieve reasonable focus with sufficient illumination of the corresponding phosphor layer.

TABLE 1

Applied ITO Voltage v. Distance

| Distance | Preferred Voltage Range (volts) | Maximum Voltage (volts) |
|---|---|---|
| 200 microns | 600–800 | 1000 |
| 600 microns | 2000–3000 | 4000 |
| 1100 microns | 6000–7000 | 9000 |

Accordingly, for a desired distance between ITO layer 190 and reflector layer 110, the voltage on ITO layer 190 may be selected to achieve a desired level of focus or image sharpness. As the distance between emitter layer 140 and reflector layer 110 is typically in the order of 1–2 microns, there is a negligible difference in the distance between emitter layer 140 and ITO layer 190.

The relatively high voltage on ITO layer 180 requires high-voltage phosphor, similar to that used on Cathode Ray Tubes (CRT), rather than the low-voltage phosphor used in current solid-state display technology. The high voltage and high-voltage phosphor is advantageous as it enables the electrons to penetrate deeper into the phosphor layer and reduces the emission of impurities into the evacuated FED pixel element, which occurs when electrons bombard the phosphor. High-voltage phosphor having low sulfur content is preferred.

As would be understood by those skilled in the art, a sold-state flat panel display using reflected electron FED pixel elements disclosed herein may be formed by arranging a plurality of reflective edge pixel elements 100, wherein emitter layers 140 are electrically connected in rows and reflector layer 110 are electrically connected in columns. The pixel elements may be formed on a single dielectric surface having spacers positioned thereon to establish a desired distance between pixel elements and transparent layer 190. The spacers further provide mechanical support when the space between the pixel elements and the transparent surface 190 is evacuated and a vacuum is contained therein.

Pixel elements may then be selected to produce an image viewable through transparent layer 190 by the application of voltages to selected rows and columns. Control of selected rows and columns may be performed by any means, for example, a processor, through appropriate row controller circuitry and column controller circuitry. As will be appreciated, a processor may be any means, such as a general purpose or special purpose computing system, or may be a hardware configuration, such as a dedicated logic circuit, integrated circuit, Programmable Array Logic, Application Specific Integrated circuit or any device that provides known voltage outputs on corresponding row and column lines in response to known inputs.

Figure 6:
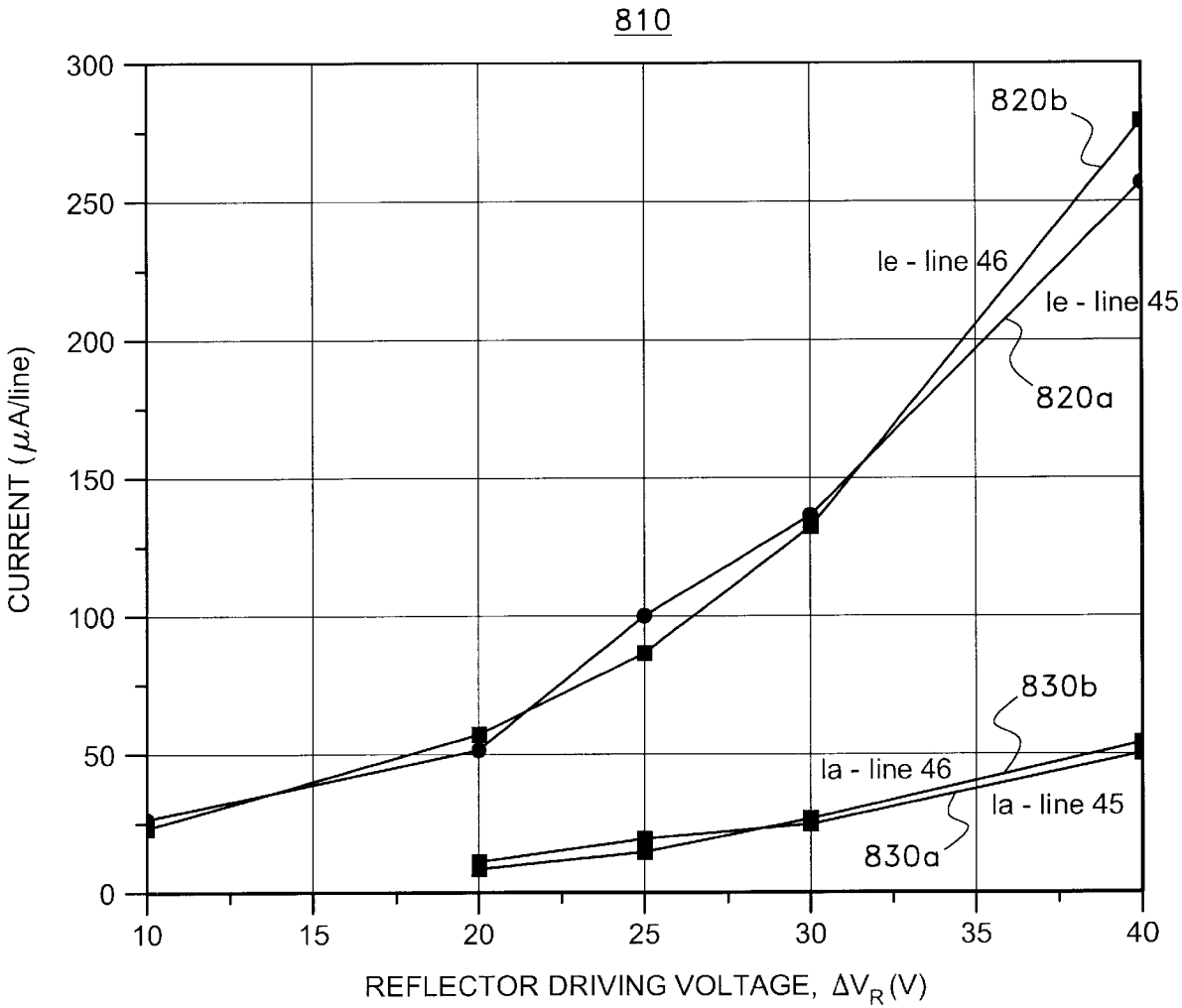
FIG. 6 illustrates a graph of line current versus reflector layer voltage for a pixel element fabricated in accordance with the principles of the invention.

FIG. 6 illustrates a graph 810 of measured line currents for two selected lines of a display constructed having 160 rows and 170 columns (160×170) of reflective pixel elements in accordance with the principles of the invention having 3 kv applied to ITO layer 180. In this illustrated example of measured currents, as the reflector layer 110 voltage, represented as $\cdot V_R$, above a known threshold voltage increases, the current drawn by emitter layers of the pixel elements in the selected row, 820*a*, 820*b*, referred to as $I_e$, is shown to increase non-linearly, but substantially consistently. Similarly, the reflected current, 830*a*, 830*b*, referred to as $I_a$ is only a portion of the emitter current.

In this specific embodiment, the threshold voltage is 90 volts. However, it would be appreciated that the threshold voltage for electron flow depends on the material selected for emitter layer 140. Hence, although the characteristics of the present invention is presented with regard to an alpha-carbon material, it would be known by those skilled in the art to substitute a metal, for example, as emitter layer 140 and adjust the threshold voltage accordingly.

Efficiency of the display may be determined as the power provided to the anode or ITO layer 180 and the power necessary to drive the display: Accordingly efficiency may be determined as:

$$\eta = \frac{I_a V_a}{I_a V_a + I_e V_r}$$

Although $I_e$ is larger than $I_a$, the efficiency remains significantly high as the value of $V_r$ is significantly lower than $V_a$.

The brightness of the FED display may be determined as $$B = \frac{\eta I_a V_a}{\pi A}$$

where A is the area of the spot size on phosphor layer 195.

While there has been shown, described, and pointed out, fundamental novel features of the present invention as applied to preferred embodiments thereof, it will be understood that various omissions and substitutions and changes in the apparatus described, in the form and details of the devices disclosed, and in their operation, may be made by those skilled in the art without departing from the spirit of the present invention. For example, it is expressly intended that all combinations of those elements which perform substantially the same function in substantially the same way to achieve the same results are within the scope of the invention. Substitutions of elements from one described embodiment to another are also fully intended and contemplated.

We claim:

1. A reflective emission pixel element comprising:

a substrate layer;

at least one reflector layer;

at least one emitter layer, electrically isolated and positioned above a corresponding one of said at least one reflector layer, said at least one emitter layer to circumjacent said at least one reflector layer;

means for applying a first potential to said at least one reflector layer, wherein a potential difference between said at least one emitter layer and said corresponding one of said at least one reflector layer is operable to draw electrons from said at least one emitter layer to said corresponding one of said reflector layer;

a transparent layer oppositely positioned a predetermined distance from said at least one emitter layer, said transparent layer having a conductive layer deposited thereon;

means for applying a second potential to said conductive layer to attract electrons reflected from said at least one reflective layer;

at least one phosphor layer on said conductive layer oppositely opposed to said corresponding one of said at least one reflector layer.

2. The pixel element as recited in claim 1, further comprising:

a vacuum created between said substrate layer and said transparent layer.

3. The pixel element as recited in claim 1, wherein said at least one emitter layer is selected from a group comprising: chromium, niobium, vanadium, aluminum, molybdenum, gold, silver, copper.

4. The pixel element as recited in claim 1, wherein said at least one reflector layer is selected from a group comprising: aluminum, chromium, niobium, vanadium, gold, silver, copper.

5. The pixel element as recited in claim 1, wherein said at least one emitter layer further comprising:

a conductive layer; and an emitter edge layer in electrical contact with said conductive layer.

6. The pixel element as recited in claim 5, wherein said emitter edge layer is an alpha-carbon material.

7. The pixel element as recited in claim 5, further comprising:

a resistive material imposed between said conductive layer and said edge emitter layer.

8. The pixel element as recited in claim 7, wherein said resistive material is an alpha-silicon material.

9. The pixel element as recited in claim 5, further comprising:

means for selectively applying a third potential to said conductive layer, wherein said third potential is more negative than said first potential.

10. The pixel element as recited in claim 5, further comprising:

a dielectric material deposited on said emitter edge layer.

11. The pixel element as recited in claim 1, wherein said at least one phosphor layer is a high-voltage phosphor.

12. The pixel element as recited in claim 11, wherein said at least one phosphor layer is selected from a group comprising: red, green, blue.

13. The pixel element as recited in claim 1, wherein said at least one emitter layer is distributed within said pixel element.

14. The pixel element as recited in claim 1, wherein said at least one emitter layer extends over said at least one reflector layer.

15. The pixel element as recited in claim 1, wherein said at least one emitter layer is partitioned into a plurality of digits extending over the corresponding one of said reflector layer.

16. The pixel element as recited in claim 1, wherein said second potential is selectively applied to selected areas of said transparent electrode layer.

17. The pixel element as recited in claim 1, wherein said first potential includes a known constant potential and a potential applied as a pulse.

18. The pixel element as recited in claim 1, further comprising:

means for selectively applying a third potential to said at least one emitter layer, wherein said third potential is more negative than said first potential.

19. The pixel element as recited in claim 18 wherein a difference between said first potential and said third potential exceeds a known threshold value.

20. The pixel element as recited in claim 1, further comprising:

a connectivity layer associated with each of said at least one reflective layer, said connectivity layer positioned between said at least one reflective layer and said substrate layer.

21. The pixel element as recited in claim 20, wherein said second potential is determined to achieve a desired level of image sharpness.

22. The pixel element as recited in claim 1, wherein said second potential is determined based on said predetermined distance.

23. A reflective edge Field Emission Display (FED) comprising:

a substrate layer having fabricated thereon a plurality of reflective pixel elements arranged in a matrix of rows and columns thereon, each of said pixel elements identified by a row and a column designation comprising:

at least one reflector layer deposited on said substrate; and an emitter layer electrically isolated from and having an edge operable to emit electrons therefrom shaped to bound a corresponding one of said at least one reflector layer;

a transparent layer electrically isolated from said substrate layer, having deposited thereon:

at least one conductive layer; and a phosphor layer associated with each of said at least one conductive layer, wherein said phosphor layer is oppositely opposed to a corresponding one of said at least one reflector layer;

at least one non-conductive spacer selectively positioned between said substrate layer and said transparent layer to maintain a substantially desired distance between said substrate layer and said transparent layer; and a seal between said substrate layer and said transparent layer operative to sustain a vacuum therebetween.

24. The FED as recited in claim 23, wherein said pixel element emitter layers are electrically connected in said rows and said reflector layers are electrically connected in said columns.

25. The FED as recited in claim 23, wherein said pixel element emitter layers are electrically connected in said columns and said reflector layers are electrically connected said rows.

26. The FED as recited in claim 23, further comprising:

means for applying a first potential to each of said at least one reflector layer;

means for applying a second potential, determined in relation to said distance, to each of said at least one conductive layer;

means for applying a third potential to each of said emitter layers, wherein a potential difference between said first potential and said third potential is operable to attract electrons emitted by an associated emitter layer.

27. The FED as recited in claim 26, wherein said potential difference is a range of 10–200 volts.

28. The FED as recited in claim 26, wherein said first potential is in a range of 0–100 volts greater than a threshold potential.

29. The FED as recited in claim 28, wherein said threshold potential is determined based on said emitter layer material.

30. The FED as recited in claim 26, wherein said first potential comprises a constant potential and a potential applied as pulse.

31. The FED as recited in claim 26, wherein said second potential is in a range of 1000–9000 volts.

32. The FED as recited in claim 23, wherein said conductive layer is partitioned into a plurality of electrically isolated stripes.

33. The FED as recited in claim 23, wherein said phosphor layer is a high-voltage phosphor.

34. The FED as recited in claim 23, wherein said phosphor layer has a minimum amount of sulfur content.

35. The FED as recited in claim 23, wherein said at least one reflector layer is selected from a group comprising gold, silver, aluminum, copper, chromium, niobium, vanadium, molybdenum.

36. The FED as recited in claim 23, wherein said at least one reflector layer is niobium.

37. The FED as recited in claim 23, wherein said emitter layer is selected from a group comprising gold, silver, aluminum, copper, chromium, niobium, vanadium, molybdenum.

38. The FED as recited in claim 23, wherein said emitter layer is molybdenum.

39. The FED as recited in claim 23, wherein said pixel element further comprises:

a second conductive layer imposed between said emitter layer and said substrate, said second conductive layer being in electrical contact with said emitter layer and electrically isolated from said at least one reflector layer.

40. The FED as recited in claim 39, wherein said emitter layer is a resistive material.

41. The FED as recited in claim 40, wherein said emitter layer is an alpha-carbon.

42. The FED as recited in claim 23, wherein said pixel element further comprises:

a resistive material imposed between said second conductive layer and said emitter layer.

43. The FED as recited in claim 42, wherein said resistive material is an alpha-silicon.

44. The FED as recited in claim 23, wherein said pixel element further comprises:

an insulating layer deposited on said emitter layer.

45. The FED as recited in claim 23, wherein said emitter layer shape is selected from a group comprising: square, rectangle, circle, triangle.

46. The FED as recited in claim 23, wherein a light color emitted by said phosphor layer is selected from a group comprising: red, blue, green.

47. The FED as recited in claim 23, wherein said emitter layer edge is aligned to an edge of a corresponding one of said at least one reflector layer.

48. The FED as recited in claim 23, wherein said emitter layer edge extends over a corresponding one of said at least one reflector layer.

49. The FED as recited in claim 23, wherein said emitter layer is partitioned into a plurality of digits.

50. The FED as recited in claim 23, wherein said emitter layer digits extend over a corresponding one of said at least one reflector layer.

51. The FED as recited in claim 23, wherein said vacuum is in the range of $10^{-5}$ to $10^{-7}$ torr.

* * * * *